US007654632B2

(12) United States Patent
Chen

(10) Patent No.: US 7,654,632 B2
(45) Date of Patent: Feb. 2, 2010

(54) INKJET HEAD CLEAN DEVICE FOR INKJET PRINTER

(76) Inventor: Jack Chen, No. 8, Gongyecyu 30th Rd., Situn District, Taichung City 407 (TW)

( * ) Notice: Subject to any disclaimer, the term of this patent is extended or adjusted under 35 U.S.C. 154(b) by 524 days.

(21) Appl. No.: 11/485,302

(22) Filed: Jul. 13, 2006

(65) Prior Publication Data

US 2008/0012895 A1 Jan. 17, 2008

(51) Int. Cl.
*B41J 2/165* (2006.01)

(52) U.S. Cl. ..... 347/22; 347/28

(58) Field of Classification Search ..... 347/28, 347/29, 30, 26, 27, 22
See application file for complete search history.

(56) References Cited

U.S. PATENT DOCUMENTS 6,595,617 B2 * 7/2003 Sharma et al. ..... 347/28

* cited by examiner

*Primary Examiner*—Shih-Wen Hsieh

(57) ABSTRACT

An inkjet head clean device for inkjet printer includes a main body, a pump, a first guide-tube and a second guide-tube. The main body has a tank for receiving cleansing liquid. The pump that sets in the main body has a first pipe-hole and a second pipe-hole. One end of the first guide-tube connects with the first pipe-hole of the pump and another end extends into the tank. One end of the second guide-tube connects with the second pipe-hole of the pump and another end connects with an inkjet head. By the way, the clean device of present invention can wash the inkjet head by reusing the cleansing liquid and make the inkjet head clean.

13 Claims, 13 Drawing Sheets

INKJET HEAD CLEAN DEVICE FOR INKJET PRINTER

BACKGROUND OF THE INVENTION

1. Field of the Invention

The present invention relates to an inkjet printer and more particularly to an inkjet head clean device for inkjet printer.

2. Description of the Related Art

In general, inkjet heads of a small-size or medium-size inkjet printer is cheap. Most users will buy a new inkjet head to replace an old one when an old one is dirty or blocked. But, an inkjet head of a large-size inkjet printer is more expensive than small-size or medium-size inkjet printer. This will increase cost if the user buys a new one to replace an old one when it is dirty or blocked.

SUMMARY OF THE INVENTION

The object of the present invention is to provide an inkjet head clean device for inkjet printer by using liquid to clean inkjet head and make inkjet heads recyclable.

To achieve this object of the present invention, an inkjet head clean device for inkjet printer includes a main body, a pump, a first guide-tube and a second guide-tube. The main body has a tank for receiving cleansing liquid. The pump that sets in the main body has a first pipe-hole and a second pipe-hole therein. One end of the first guide-tube connects with the first pipe-hole of the pump and another end extends into the tank. One end of the second guide-tube connects with the second pipe-hole of the pump and another end connects with an inkjet head.

In one prefer embodiment of present invention, the inkjet head clean device still includes an E-tube, a F-tube, a G-tube, a first valve and a second valve. The first guide-tube has an A-tube and a B-tube. The second guide-tube has a C-tube and a D-tube. The first valve connects with the A-tube, B-tube and E-tube. The second valve connects with the C-tube, F-tube and G-tube and the D-tube connects with the E-tube and the F-tube. Both of the first valve and second valve can be switched between a first position and a second position. When the first valve is in the first position and the second valve is in the second position, the A-tube will connect with the B-tube and the F-tube will connect with the C-tube and the D-tube to wash the inkjet head top-down by cleansing liquid. When the first valve is in the second position and the second valve is in the first position, the C-tube will connect with the G-tube and the E-tube will connect with the D-tube and the B-tube to wash inkjet head bottom-up by cleansing liquid.

By the way, the inkjet head clean device of present invention can clean an inkjet head in different directions by liquid to make sure that the inkjet head can be cleaned completely and reduce the expense cost.

DETAILED DESCRIPTION OF THE INVENTION

Figure 1:
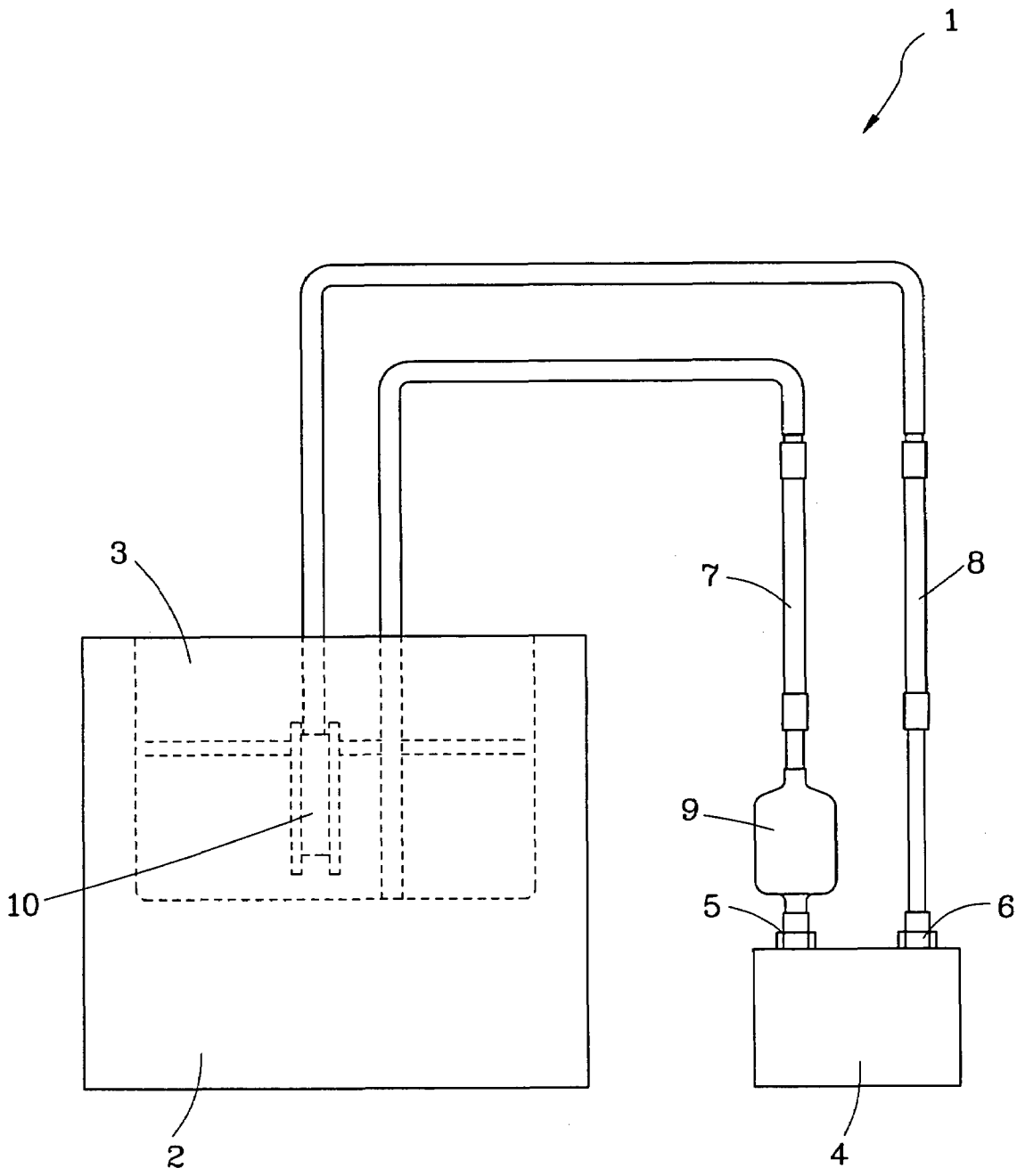
FIG. 1 is a structure layout of the first embodiment of the present invention.

Referring to FIG. 1, an inkjet head clean device 1 of the first embodiment of present invention includes a main body 2, a pump 4, a first guide-tube 7, a second guide-tube 8 and a filter 9.

The main body 2 has a rectangle body with a tank 3 on the top for receiving cleansing liquid.

The pump 4 has a first pipe-hole 5 and a second pipe-hole 6.

One end of the first guide-tube 7 connects with the first pipe-hole 5 of the pump 4 and another end extends into the tank.

One end of the second guide-tube 8 connects with the second pipe-hole 6 of the pump 4 and another end connects with an inkjet head 10.

The cleansing liquid in the tank 3 can be filtered through the filter 9 which connects with the first guide-tube 7.

According to aforesaid structures, the first guide-tube 7 can suck into the cleansing liquid in the tank 3 when the pump 4 was turned on and the cleansing liquid will run through the filter 9. Then, cleansing liquid will be reused running through the inkjet head 10 by passing the second guide-tube 8 and clean the inkjet head 10.

Figure 2:
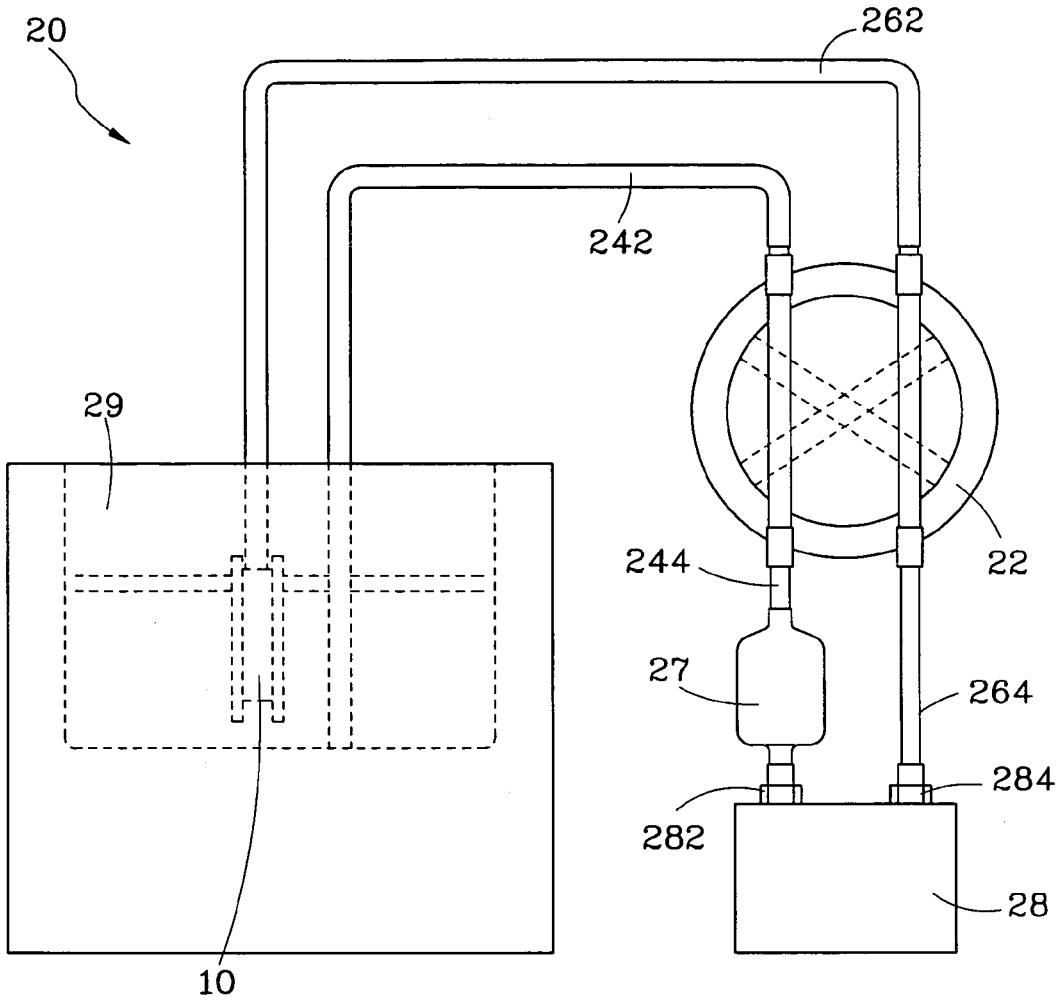
FIG. 2 is a structure layout of the second embodiment of the present invention.
Figure 3:
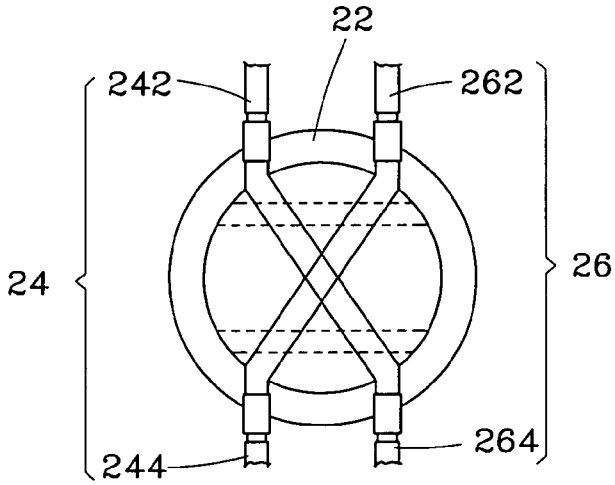
FIG. 3 is a front view showing the action of the switch device in the second embodiment of present invention.

Referring to FIG. 2 and FIG. 3, an inkjet head clean device 20 of the second embodiment of present invention includes almost the same structures as disclose in the first embodiment.

An inkjet head clean device of the second embodiment of present invention includes a switch device 22 that can be switched between a first position and a second position more over. The first guide-tube 24 has an A-tube 242 and a B-tube 244. The second guide-tube 26 has a C-tube 262 and a D-tube 264. One end of the A-tube 242 connects with the switch device 22 and another end extends into the tank 29. One end of the B-tube 244 connects with the switch device 22 and another end connects with the first pipe-hole 282 of the pump 28. One end of the C-tube 262 connects with the switch device 22 and another end connects with the inkjet head 10. One end of the D-tube 264 connects with the switch device 22 and another end connects with the second pipe-hole 284 of the pump 28.

When the switch device 22 was switched to the first position by the user, the A-tube 242 connects with the B-tube 244 and the C-tube 262 will connect with the D-tube 264. By the way, the cleansing liquid can be sucked in A-tube 242 and pass through B-tube 244, the filter 27 and the D-tube 264 in order and jetted out from the C-tube 262 finally. The inkjet head 10 can be washed top-down by reusing cleansing liquid. When the switch device 22 was switched to the second position by the user, the A-tube 242 connects with the D-tube 264 and the B-tube 244 will connects with the C-tube 262. By the way, the cleansing liquid can be sucked in C-tube 262 from the inkjet head 10 and pass through B-tube 244, the filter 27 and the D-tube 264 in order and jetted out from the A-tube 242 finally. The inkjet head 10 can be washed bottom-up by reusing cleansing liquid.

Referring to FIGS. 4-11, an inkjet head clean device 30 of the third embodiment of present invention includes a main body 40, a hoister 50, a storage frame 60, two pumps 70, two first valves 82, two second valves 84, two first guide-tubes 90, two connect tubes 100, two second guide-tubes 110, two G-tubes 120 and two filters 130.

The main body 40 has a rectangle body with a tank 41 on the top for receiving cleansing liquid. There are several control buttons 42 43 44 on the front side of the main body 40 and a control circuit 45, a heater 46 and an ultrasonic generator 47 are located inside the main body 40 and under the tank 41 as showing in FIG. 4. Those control buttons 42 43 44 connect separately with the heater 46 and the ultrasonic 47 by the circuit 45 and control the heater 46 to heat cleansing liquid in the tank or the ultrasonic generator to generate vibration. Besides, there is a support board 48 that extends from the back side of the main body 40 behind the tank 41. As shows in FIG. 6, a power switch 49 locates on the back downside of the main body 40 and connects with the circuit 45.

Figure 6:
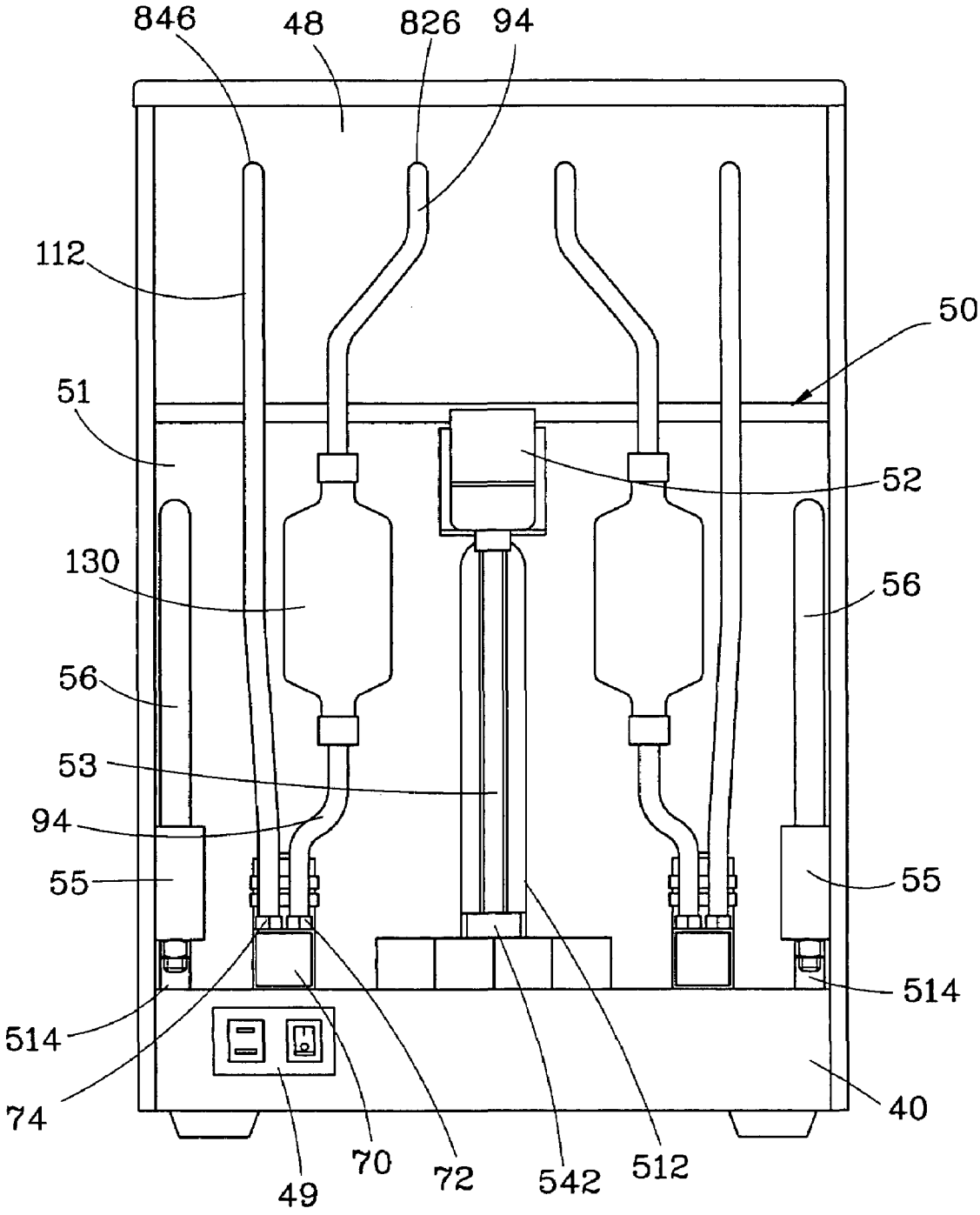
FIG. 6 is a back view of the third embodiment of present invention showing the inside structures.
Figure 7:
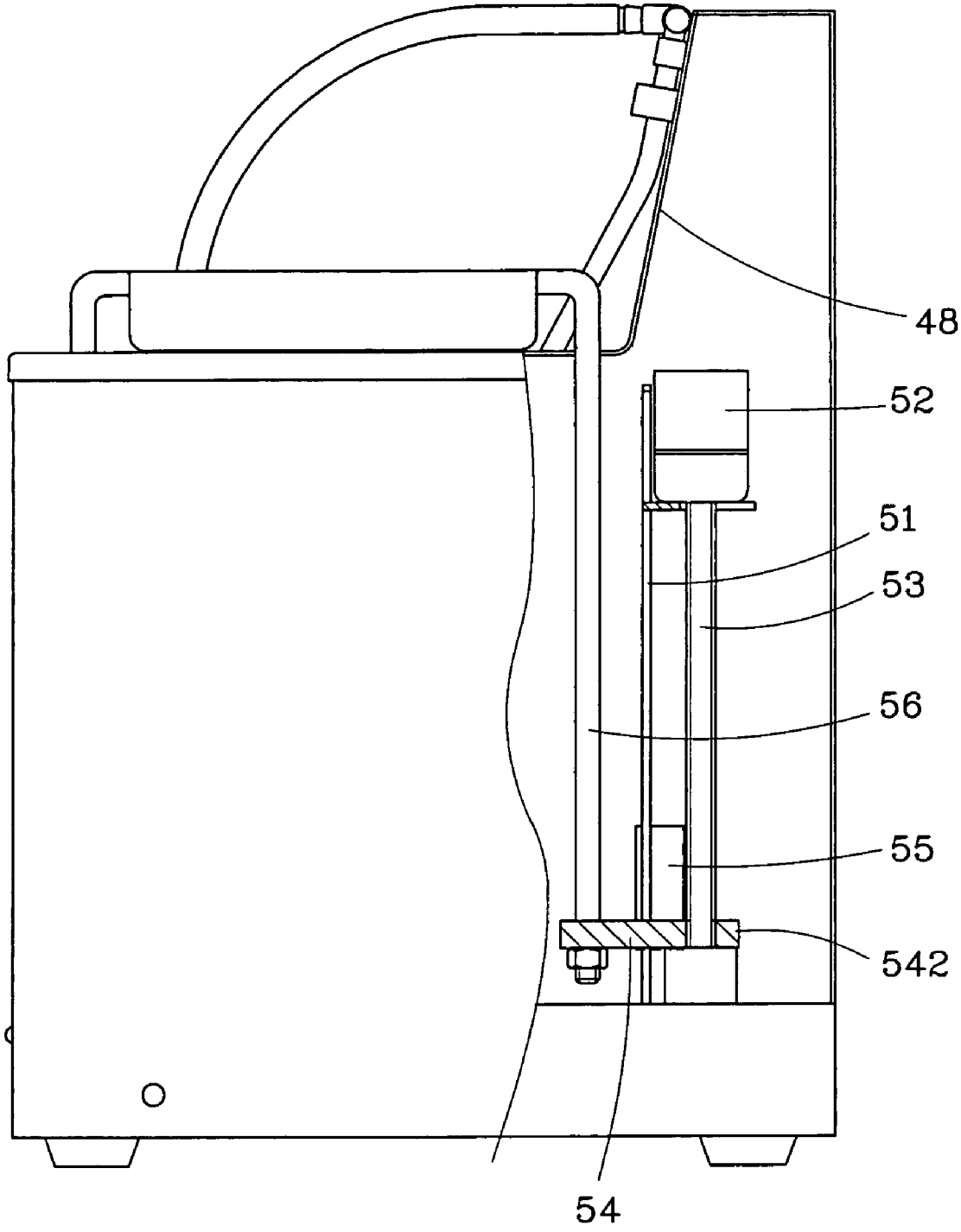
FIG. 7 is a partial section view of the third embodiment of present invention showing the status of the hoister.
Figure 8:
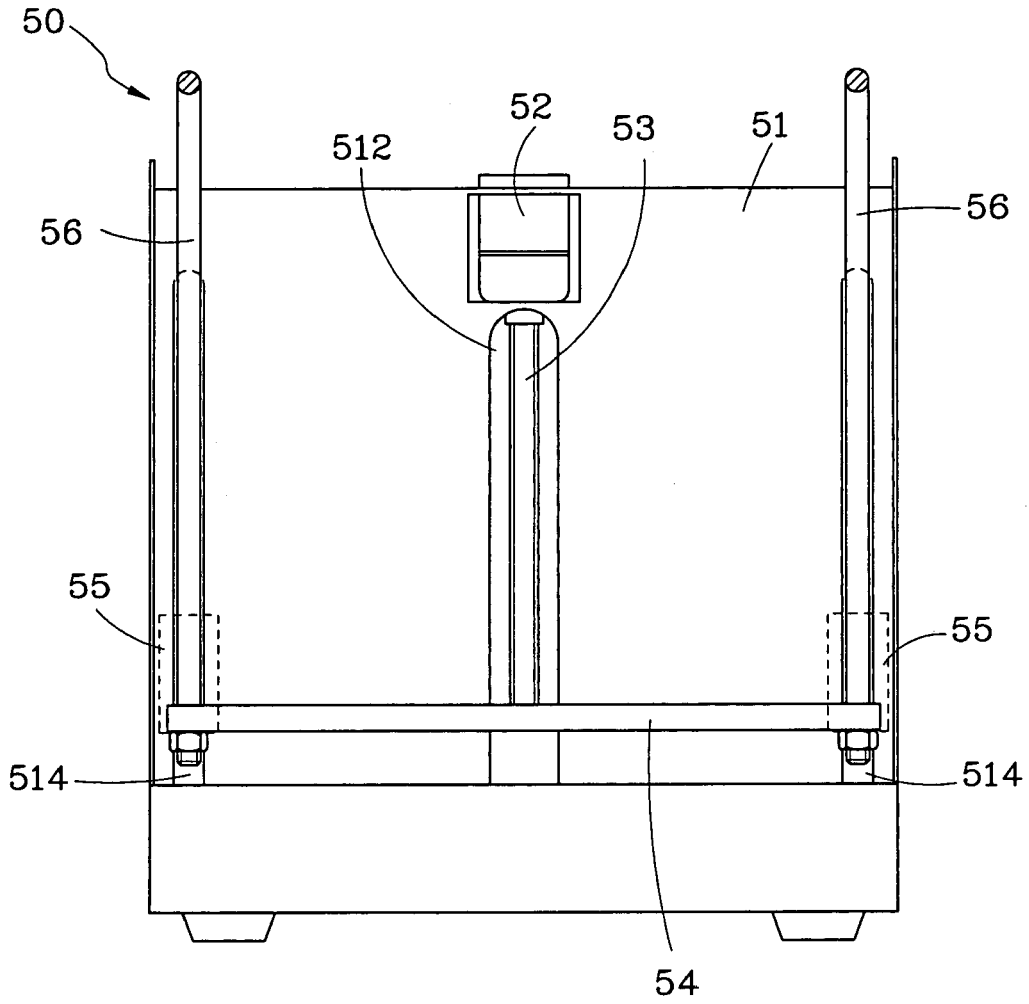
FIG. 8 is a front view of the third embodiment of present invention showing the hoister.
Figure 9:
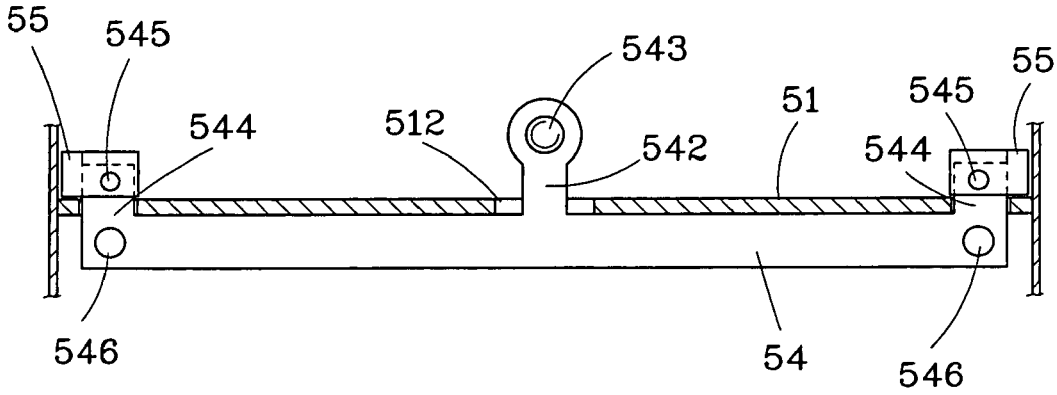
FIG. 9 is a top view of the cross bar in the third embodiment of present invention.

Referring to FIG. 6 to FIG. 8, each hoister 50 that sets in the main body 40 has a fix board 51, a drive device 52, a rotator 53, a cross bar 54, two guider 55 and two shafts 56. The fix board 51 that sets behind the supporting board 48 has a first trough 512 and two second troughs 514 which locates separate and beside the first trough 512. The drive device 52 is a motor in this embodiment and fix on the back side of the fix board 51. The drive device 52 connects with the control buttons 43 44. The rotator 53 that connects with the drive device 52 can be revolved on its own axis by the drive device 52. There is thread of a screw on the outside of the rotator 53 as showed in FIG. 8 and FIG. 9. The cross bar 54 sets in front of the fix board 51 and a first connect portion 542 extends from the middle of the cross bar 54 and a second connect portion 544 extends from each end of the cross bar 54. There is a screw hole 543 that screws on the rotator 53 on the first connect portion 542 and each of the second connect portion 544 has a through hole 545 546. Each of the guider 55 sets on the second connect portion 544 and engages with the second trough 514. The two shafts 56 is separate at the two side of the fix board 51 and the top end of each shaft 56 bends forward vertically and the button end fixes with corresponding through hole 546 on the second connect portion 544. The drive device 52 can drive the rotator 53 to rotate and the first connect portion 542 can move upward or downward along with the first trough 512 as the rotator 53 revolves on its own axis. So, two shafts 56 can move up or down with the cross bar 54 when two second connect portions 544 move along with two second troughs 514.

Figure 10:
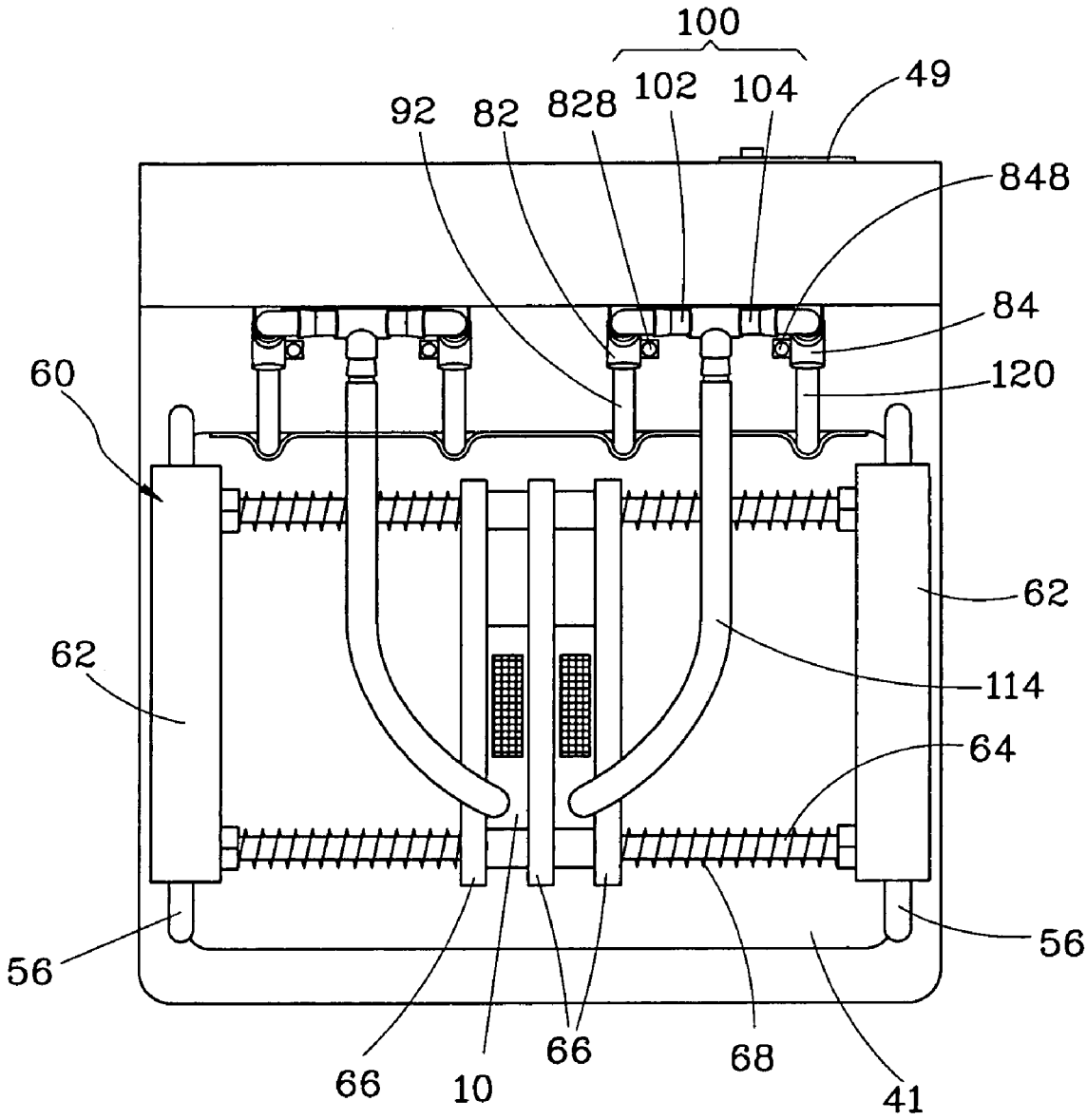
FIG. 10 is a topside view of the third embodiment of present invention.

Referring to FIG. 10, the storage frame 60 has two storage plates 62, four sticks 64 and three steadies 66. These two storage plates 62 engage with the shafts 56 of the hoister 50. Two of these four sticks 64 fix parallel on the front side of the storage plate 62 and another two sticks 64 fix parallel on the back side of the storage plate 62. These three steadies 66 arrange between these four sticks 64 and separate in distance for holding the inkjet head 10. Between the steady 66 and the storage plate 62, there is an elastic member 68 (as a spring shown in FIG.) on each of the sticks 64. One end of the elastic member 68 against the steady 66 and another end against the storage plate 62. When the user wants to place an inkjet head between these steadies 66, the steady 66 that locates at the most outside will move forward to the storage plate 62 to increase the space for holding the inkjet head and compress the elastic member 68. After the inkjet head is placed, the steady 66 can be moved backward to the inkjet head 10 by the elasticity of the elastic member 68 and hold the inkjet head therein.

Reference to FIG. 6, every pump 70 that set inside the main body 40 and behind the fix board 51 of the hoister 50 has a first pipe-hole 72 and a second pipe-hole 74.

Figure 4:
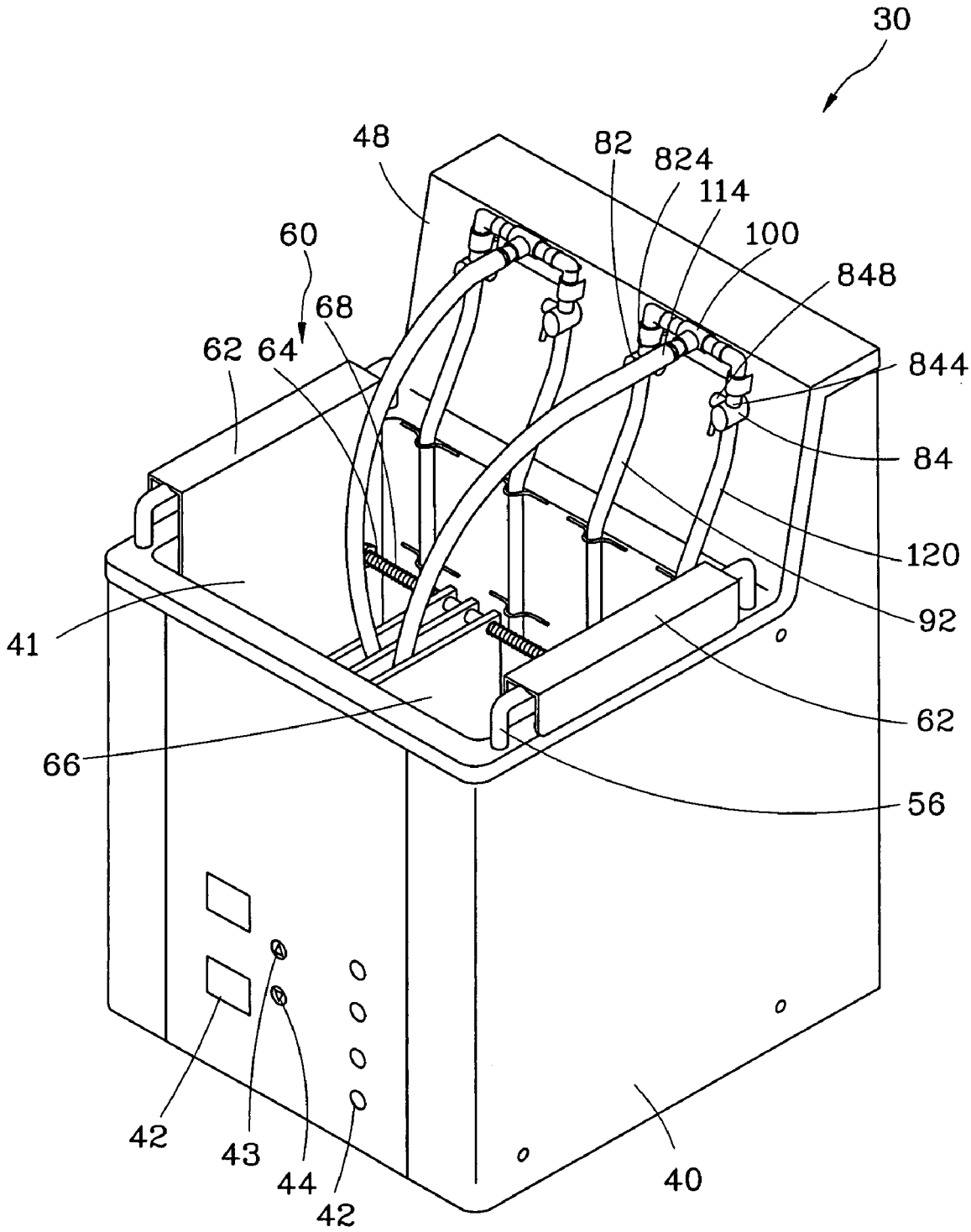
FIG. 4 is a perspective view of the third embodiment of present invention.
Figure 5:
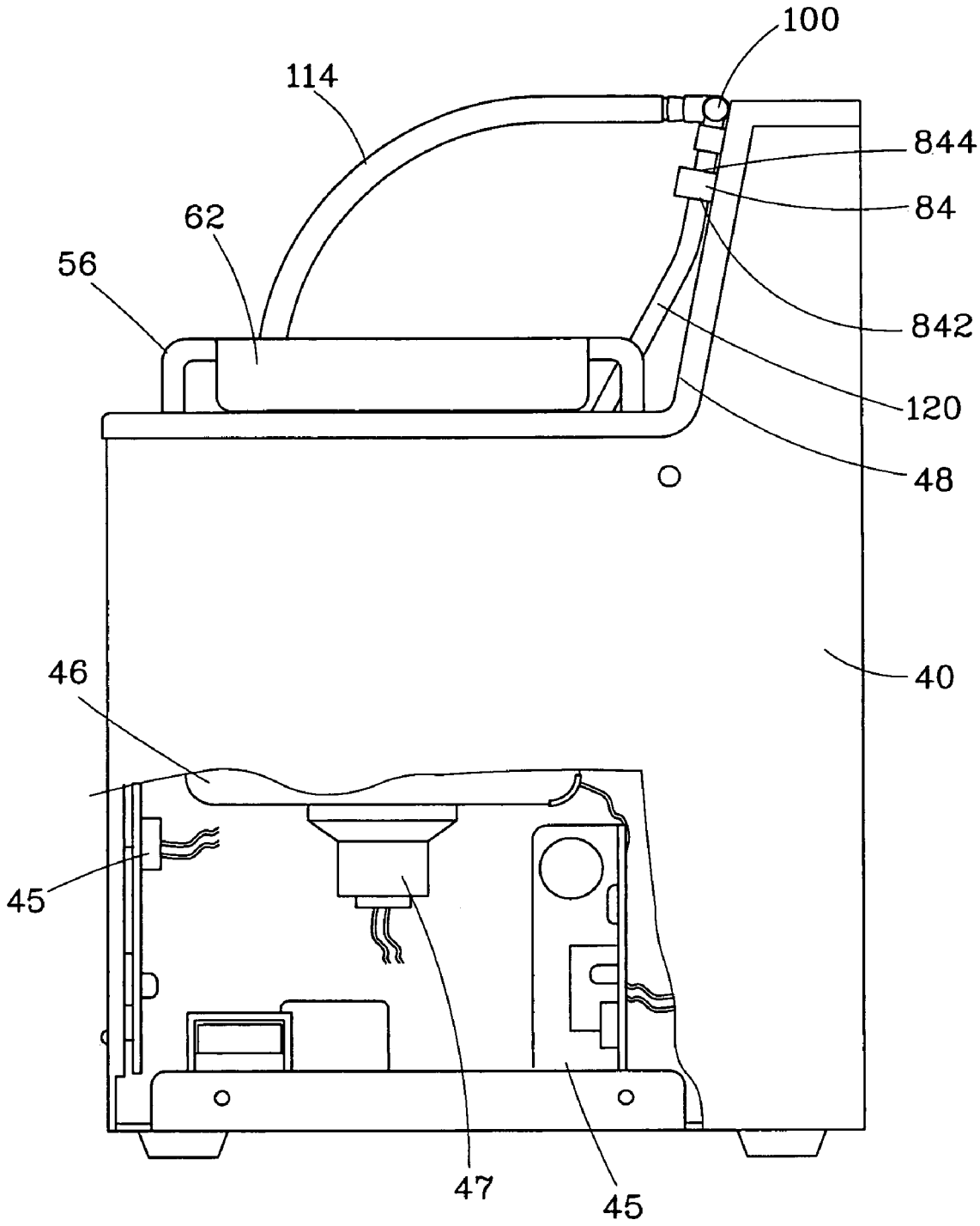
FIG. 5 is a partial section view of the third embodiment of present invention showing the location of the heating device and the ultrasonic generator.

Reference to FIG. 4, FIG. 6 and FIG. 10, every first valve 82 that set on the support board 48 of the main body 40 has a down jointer (not shown in FIG), an up jointer 824, a back jointer 826 and a switch holder 828. The up jointer 824, down jointer and the switch holder 828 all set on the front side of the support board 48 and the back jointer 826 set on the backside of the support board 48. Each of the first valves 82 can switch between a first position and a second position by a corresponding switch holder 828. The down jointers connect with the back jointers 826 when the first valves 82 are in the first position and the up jointers 824 connect with the back jointers 826 when the first valves 82 are in the second position.

Every second valve 84 that set on the support board 48 of the main body 40 has a down jointer 842, an up jointer 844, a back jointer 846 and a switch holder 848. The down jointer 842, up jointer 844 and the switch holder 848 all set on the front side of the support board 48 and the back jointer 846 set on the backside of the support board 48. Each of the second valves 84 can switch between a first position and a second position by a corresponding switch holder 848. The down jointers 842 connect with the back jointers 846 when the second valves 84 are in the first position and the up jointers 844 connect with the back jointers 846 when the second valves 84 are in the second position.

Figure 11:
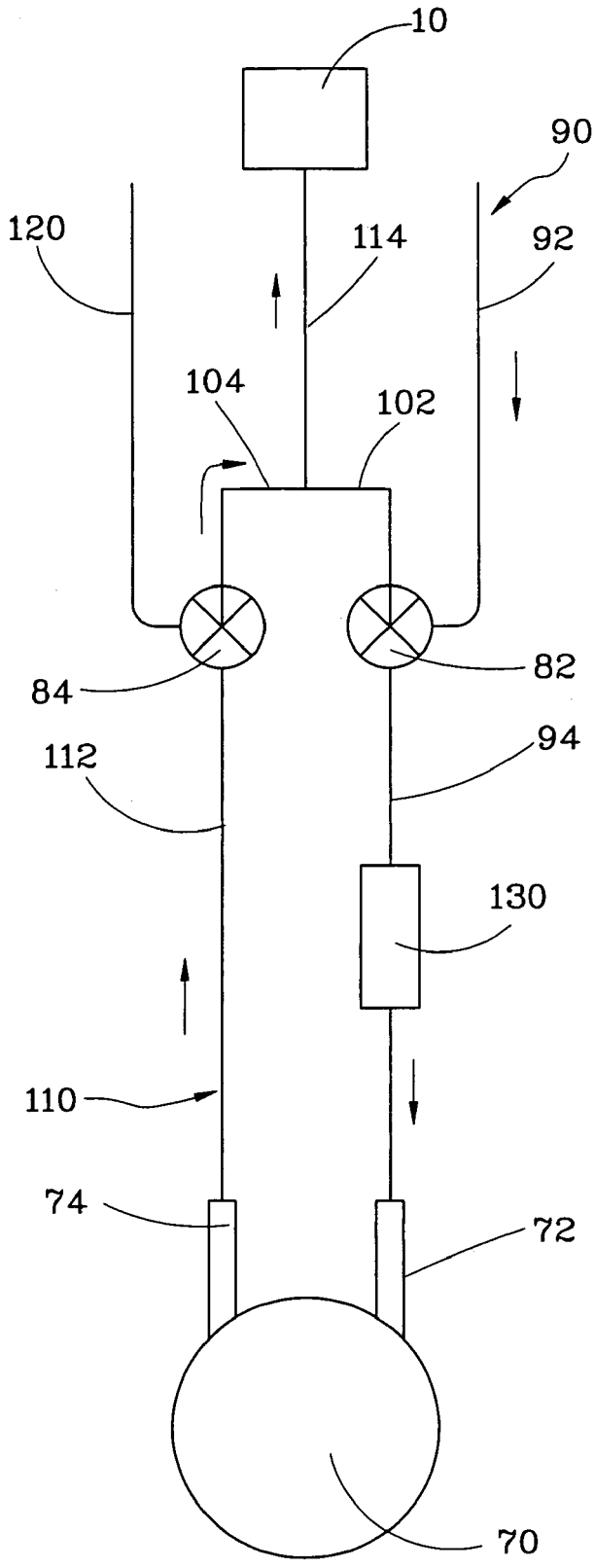
FIG. 11 is a diagram of the tubes in the third embodiment of present invention showing the inkjet head was washed top-down by the cleansing liquid.

Reference to FIG. 11, each of the first guide-tube 90 has an A-tube 92 and a B-tube 94. One end of the A-tube 92 connects with the down jointer of the first valve 82 and another end extends into the tank 41. One end of the B-tube connects with the back jointer 826 of the first valve 82 and another end connects with the first pipe-hole 72 of the pump 70.

All connect tube 100 set on the front side of the support board 48 and includes an E-tube 102 and a F-tube 104. One end of the E-tube 102 connects with the F-tube 104 and another end connects with the up jointer 824 of the first valve 82 and another end of the F-tube connects with the up jointer 844 of the second valve 84.

Each of the second guide-tubes 110 has a C-tube 112 and a D-tube 114. One end of the C-tube 112 connects with the back jointer 846 of the second valve 84 and another end connects with the second pipe-hole 74 of the pump 70. One end of the D-tube 114 connects with the E-tube 102 and F-tube 104 and another end connects with the inkjet head 10.

One end of each G-tubes 120 connect with the down jointer 842 of the second valve 82 and another end extend into the tank 41.

The filters 130 that mount on the fix board 51 of the hoister 50 are placed between the first valve 82 and the pump 70 and connect with the B-tube 94 for filtering the cleansing liquid in the tank 41.

Figure 12:
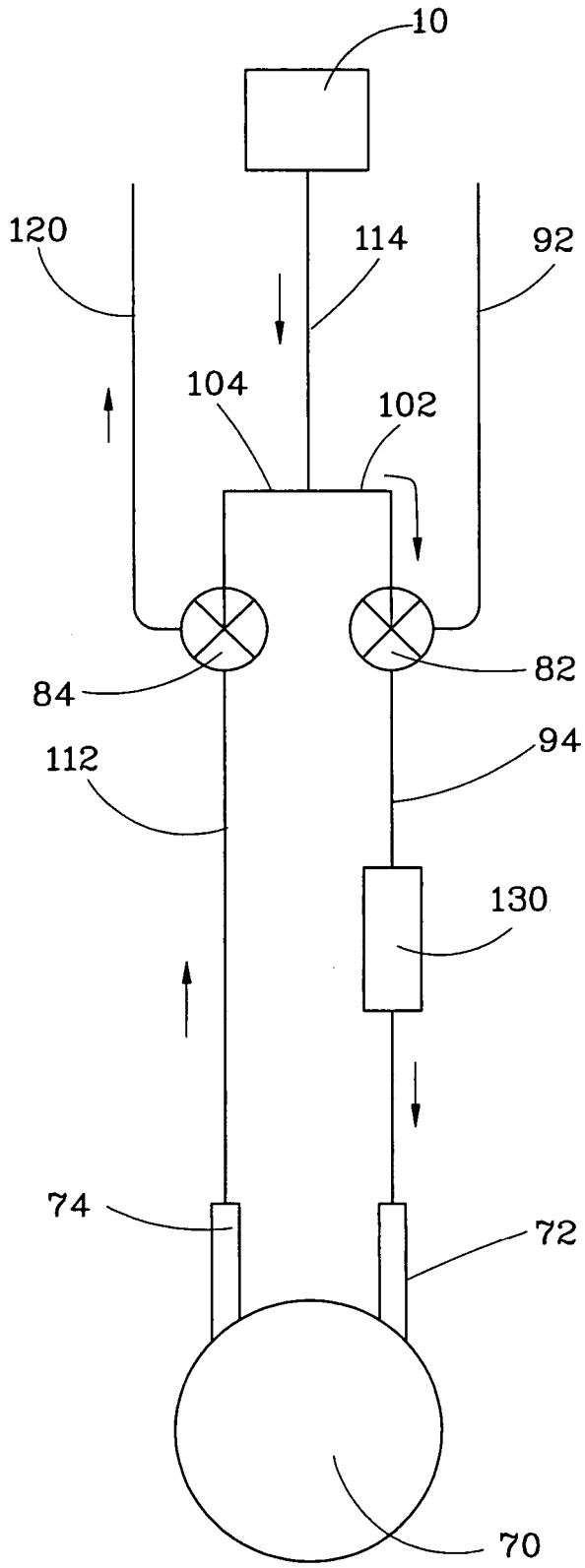
FIG. 12 is another diagram of the tubes in the third embodiment of present invention showing the inkjet head was washed bottom-up by the cleansing liquid.

Referring to FIG. 4 and FIG. 6, when user wants to wash an inkjet head by using the clean device of this embodiment, the inkjet head 10 should be placed between steadies 66 first and is dipped in cleansing liquid in the tank 41 then the D-tube 114 connects with the inkjet head 10. The first valve 82 must switch to the first position to make the down jointer connect with the back jointer 826 if user wants to wash the inkjet head button-up. Then, the second valve 84 must switch to the second position to make the up jointer 844 connect with the back jointer 846. By the way, the cleansing liquid will be sucked into the A-tube 92 and run through the B-tube, the filter 130, the C-tube 112, the F-tube 104 in order and then jet out of the D-tube to wash the inkjet head by reusing cleansing liquid as shown in FIG. 11 when user turns on the power switch 49. When user wants to wash an inkjet head top-down, the first valve 82 must switch to the second position to make the up jointer 824 connect with the back jointer 826 and the second valve 84 must switch to the first position to make the down jointer 842 connect with the back jointer 846 meanwhile. By the way, the cleansing liquid will be sucked into the D-tube 114 and go through the E-tube 102, B-tube 94, the filter 130 and the C-tube 112 and then jet out of the G-tube 120 to wash the inkjet head 10 by reusing cleansing liquid as shown in FIG. 12 when user turns on the power switch 49. The user can heat the cleansing liquid in the tank 41 with the heater 46 or generate ultrasonic with the ultrasonic generator 47 by those control buttons 52 to increase clean efficacy during clean process.

Figure 13:
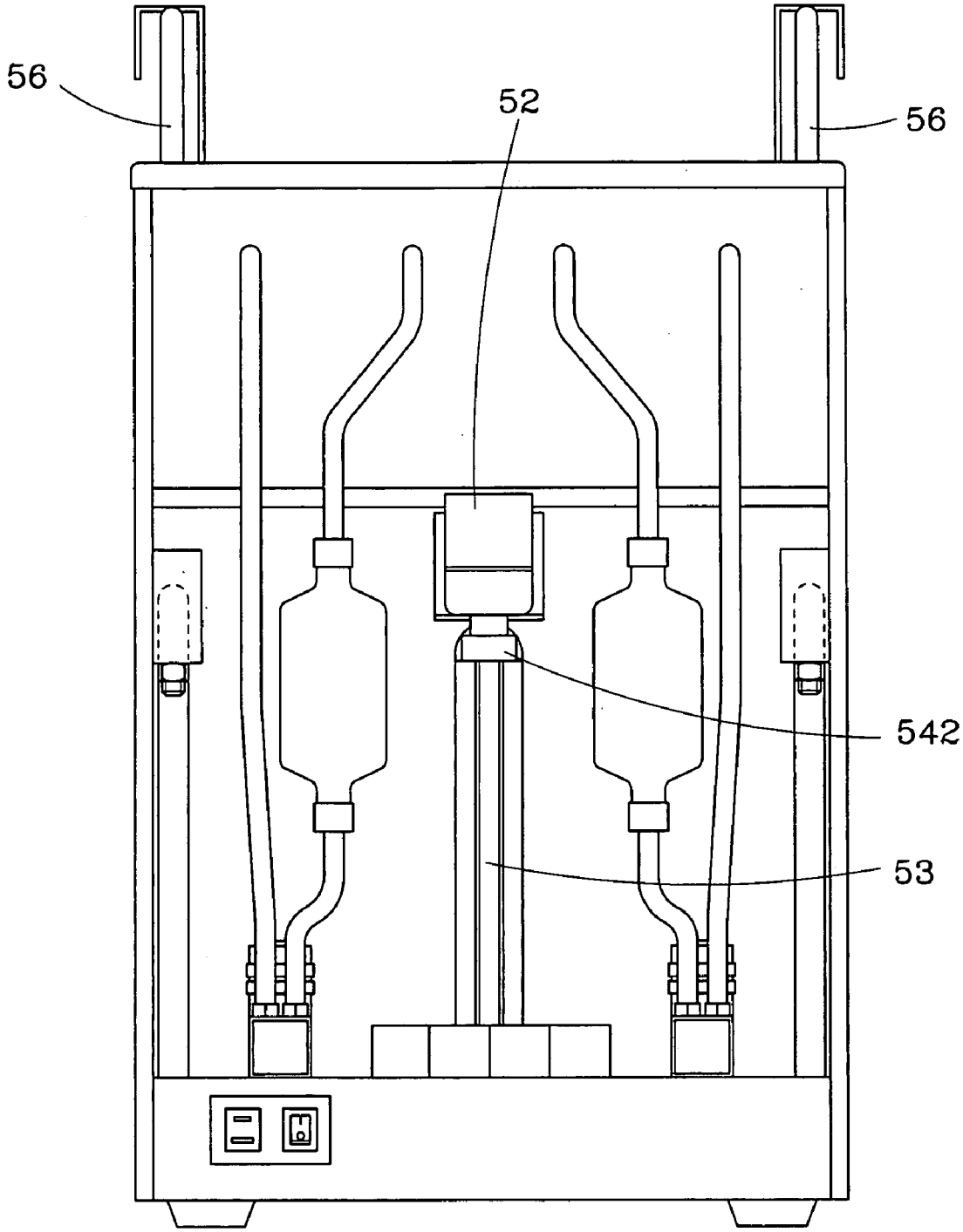
FIG. 13 is a back view of the third embodiment of present invention, showing the hoister in the up position.
Figure 14:
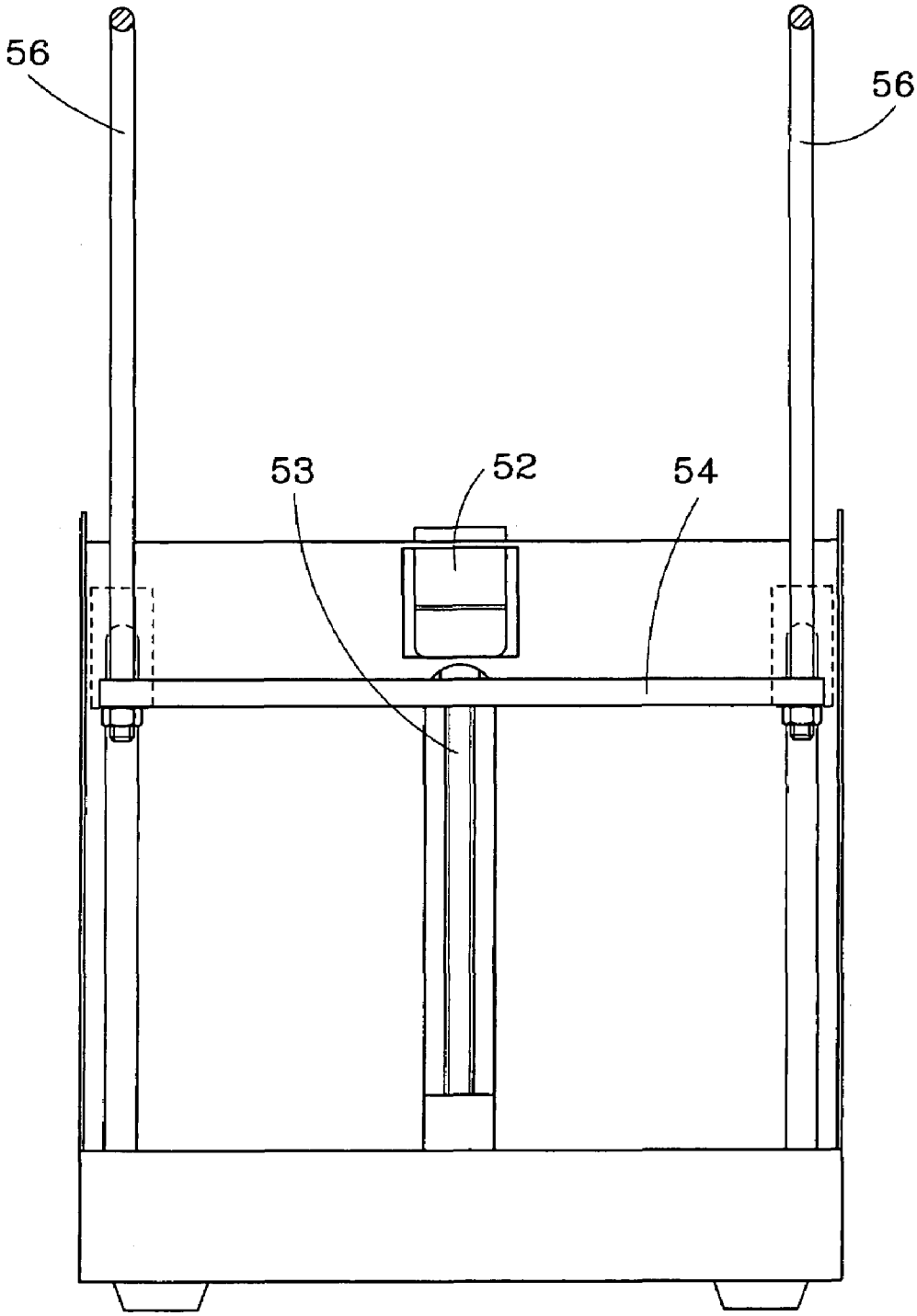
FIG. 14 is a front view of the third embodiment of present invention, showing the hoister in the up position.
Figure 15:
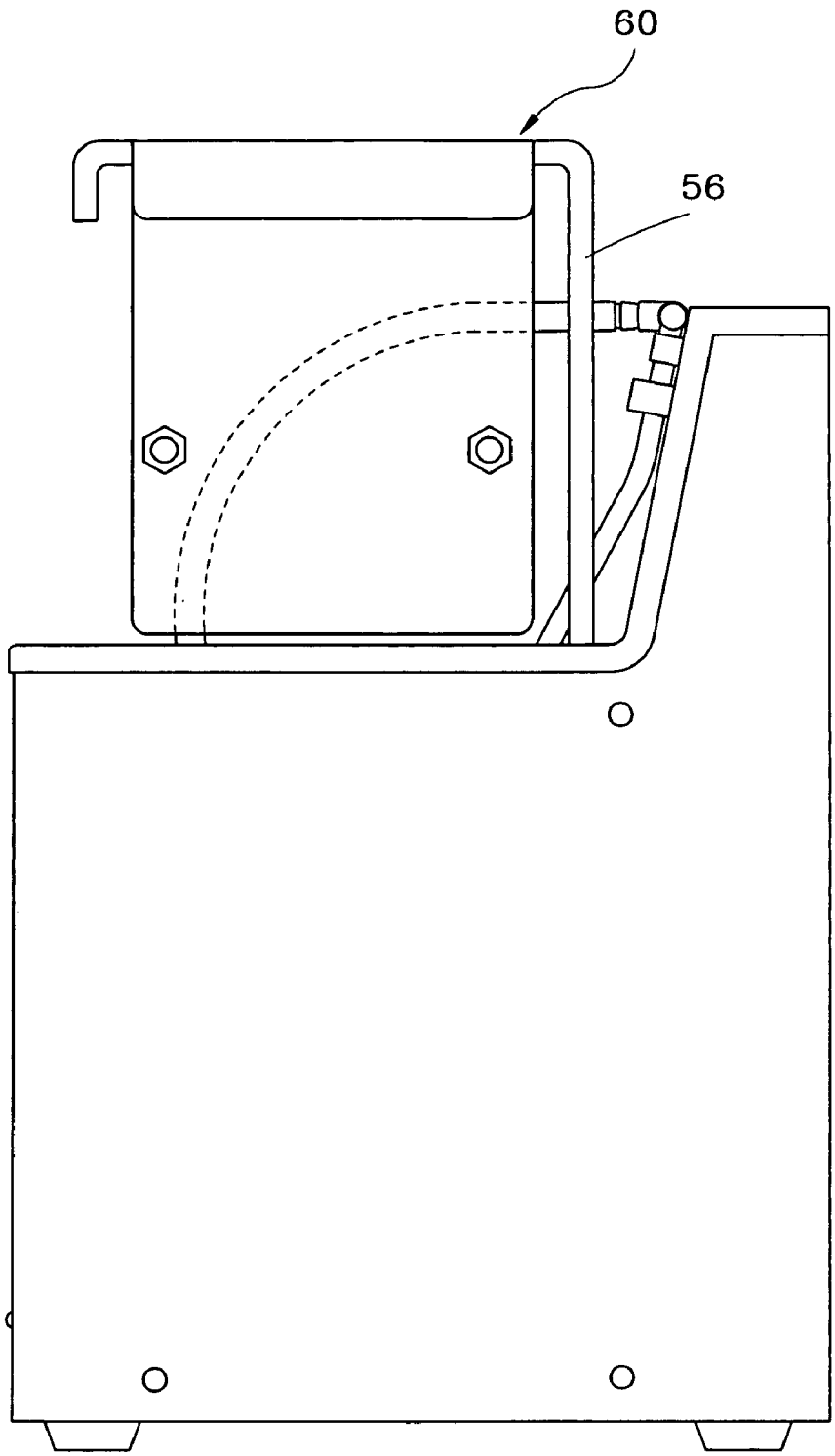
FIG. 15 is a side view of the third embodiment of present invention, showing the storage frame in the up position.

Reference to FIG. 13, in order to check the clean states of the inkjet head, the user can press the control button 43 and make the drive device 52 to drive the rotator 53 rotated. The cross bar 54 and the shafts 56 will move upward by the rotator 53 as shown in FIG. 14. At the same time, the storage frame 60 will move upward by these two shafts 56 and lift the inkjet head 10 out of the tank 41 as shown in FIG. 15. So, the user can observe the fluid situation of the cleansing liquid on the inkjet head 10. The inkjet head can be taken out if the cleansing liquid can flow through the inkjet head smoothly. The cleansing liquid can not flow through the inkjet head smoothly if the inkjet head is blocked still. AT this time, the user needs to press the control button 44 again to rotating the rotator 53 reversely and sink the inkjet head 10 into the cleansing liquid in the tank 41 to continue the clean process.

By the way, present invention provides different embodiments that can achieve the same function to wash the inkjet head and clean the inkjet head. So, the object of cost saving can be achieved and the inkjet head can be reused.

What is claimed is:

1. An inkjet head clean device, comprising:

a main body having a tank For holding an inkjet head no be cleaned;

a pump in he main body and having first pipe-hole and a second pipe-hole;

a first guide-tube having a first end connecting the first pipe-hole of the pump and a second end extending into the tank;

a second guide-tube having one end connecting the second pipe-hole of the pump and having another end for connecting to the inkjet head to be cleaned inside the tank; and a switch device which can be switched between a first position and a second position;

wherein the first guide-tube includes an A-tube and a B-tube and the second guide-tube includes a C-tube and a D-tube; the A-tube connects with the B-tube and the C-tube connects with the D-tube when the switch device is in the first position; the A-tube connects with the D-tube and the B-tube connects with the C-tube when the switch device is in the second position.

2. The inkjet head clean device as claimed in claim 1, further comprises a filter connecting the first guide-tube.

3. The inkjet head clean device as claimed in claim 1, wherein the main body comprises a heater for heating a liquid in the tank.

4. The inkjet head clean device as claimed in claim 1, wherein the main body comprises an ultrasonic generator for generating ultrasonic.

5. An inkjet head clean device, comprising:

a main body having a tank for holding an inkjet head to be cleaned;

a pump in the main body and having a first pipe-hole and a second pipe-hole;

a first guide-tube living a first end connecting the first pipe-hole of the pump and a second end extending into the tank; and a second guide-tube having one end connecting the second pine-hole of the pump and having the other end for connecting to the inkjet head to be cleaned inside the tank, further comprising an E-tube, a F-tube, a G-tube, a first valve, and a second valve;

wherein both of the first valve and second valve can be switched between a first position and a second position; the first guide-tube has an A-tube and a B-tube and the second guide-tube has a C-tube and a D-tube; the first valve connects with the A-tube, B-tube, E-tube and the second valve connects with the C-tube, F-tube, G-tube and D-tube connects with the E-tube and F-tube; the A-tube connects with the B-tube and the F-tube connects with the D-tube and F-tube when the first valve is in the first position and the second valve is in the second position; the E-tube connects with the D-tube and B-tube and the C-tube connects with the G-tube when the first valve is in the second position and the second valve is in the first position.

6. The inkjet head clean device as claimed in claim 5, further comprising a connect tube, the connect tube comprising an E-tube and a F-tube.

7. The inkjet head clean device as claimed in claim 5, wherein one end of the A-tube connects with the first valve and the other end of the A-tube extends into the tank; the B-tube connects with the first pipe-hole of the pump and the first valve; the C-tube connects with the second pipe-hole of the pump and the second valve; one end of the D-tube connects with the inkjet head; the G-tube connects with the tank and the second valve.

8. An inkjet head clean device, comprising:

a main body has a tank;

a pump sets in the main body and has a first pipe-hole and a second pipe-hole;

a first guide-tube connects with the first pipe-hole of the pump and another end extends into the tank;

a second guide-tube connects with the second pipe-hole of the pump and another end connects with an inkjet head; and a hoister and a storage frame; the hoister sets in the main body and the storage frame sets on the hoister; the storage frame can move out or in the tank by the hoister.

9. The inkjet head clean device as claimed in claim 8, wherein the hoister has a driver device, a rotator that connects with the driver device, two shafts and a cross bar; the storage frame sets on these two shafts; the cross bar has a first connect portion and two second connect portions; the first connect portion connects with the rotator and each of the shaft sets on the second connect portion; the driver device can drive the rotator rotated to move the cross bar and shafts upward or downward.

10. The inkjet head clean device as claimed in claim 9, wherein the storage frame has two storage plates, at least two sticks and at least two steadies; the two storage plates set on two shafts separately and both ends of the two sticks connect with the storage plate; the two steadies is arranged between the two sticks and are separated in a distance for holding the inkjet head; wherein an elastic member is positioned on each of the two sticks and one end of the elastic member is against the steady and the other end of the elastic member is against the storage plate.

11. The inkjet head clean device as claimed in claim 9, wherein the rotator has a thread of a screw on an outside surface and the first connect portion has a screw hole for screwing the cross bar to the rotator.

12. The inkjet head clean device as claimed in claim 9, wherein the hoister has a fix board with three troughs corresponding with the first and second connect portions; the connect portions engage with the corresponding trough; the connect portions change location in the trough when the cross bar moves.

13. The inkjet head clean device as claimed in claim 12, wherein the hoister has two guiders corresponding to the two second connect portions; each of the guider sets on the corresponding second connect portion and engages with the corresponding trough.

* * * * *

UNITED STATES PATENT AND TRADEMARK OFFICE

CERTIFICATE OF CORRECTION

PATENT NO. : 7,654,632 B2
APPLICATION NO. : 11/485302
DATED : February 2, 2010
INVENTOR(S) : Jack Chen It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 728 days.

Signed and Sealed this

Twenty-third Day of November, 2010

David J. Kappos

David J. Kappos
*Director of the United States Patent and Trademark Office*